US009400098B2

(12) United States Patent
Naumann et al.

(10) Patent No.: US 9,400,098 B2
(45) Date of Patent: Jul. 26, 2016

(54) COVERING AND LUMINAIRE HAVING SUCH A COVERING

(75) Inventors: Reiner Naumann, Mannheim (DE); Gerhard Schwarz, Schönbrunn (DE); Rudolf Brandel, Hesseneck (DE)

(73) Assignee: COOPER CROUSE-HINDS GMBH, Soest (DE)

( * ) Notice: Subject to any disclaimer, the term of this patent is extended or adjusted under 35 U.S.C. 154(b) by 0 days.

(21) Appl. No.: 14/123,730

(22) PCT Filed: Jun. 4, 2012

(86) PCT No.: PCT/EP2012/002394
§ 371 (c)(1),
(2), (4) Date: Jun. 9, 2014

(87) PCT Pub. No.: WO2012/163552
PCT Pub. Date: Dec. 6, 2012

(65) Prior Publication Data

US 2014/0307448 A1 Oct. 16, 2014

(30) Foreign Application Priority Data

Jun. 3, 2011 (DE) ..... 10 2011 103 491

(51) Int. Cl.
*F21V 25/12* (2006.01)
*F21V 3/04* (2006.01)
*F21V 31/00* (2006.01)

(52) U.S. Cl.
CPC ..... *F21V 25/12* (2013.01); *F21V 3/0418* (2013.01); *F21V 31/005* (2013.01)

(58) Field of Classification Search
CPC ..... F21V 25/12; F21V 3/0418
See application file for complete search history.

(56) References Cited

U.S. PATENT DOCUMENTS 1,921,069 A * 8/1933 Buchanan ..... F21V 25/02 362/21
2,050,839 A * 8/1936 Hastings ..... F21V 25/12 362/267

(Continued)

FOREIGN PATENT DOCUMENTS

CN 102047380 5/2011
DE 429720 6/1926

(Continued)

OTHER PUBLICATIONS

Peter Huber, DE Application No. 102011103491.2 German Examination Report, Mar. 12, 2012, 5 pages, Deutsches Patent- und Markenamt.

(Continued)

*Primary Examiner* — Elmito Breval
(74) *Attorney, Agent, or Firm* — King & Spalding LLP

(57) ABSTRACT

A cover, in particular for an explosion-proof luminaire at least comprises a mounting frame, which is detachably fastened to the luminaire, and a transparent luminaire cover held at least along a circumferential edge by the mounting frame. In order to improve a cover of this nature to the effect that it is protected in a cost-effective manner and without substantial constructive effort from the occurrence of microcracks due to the effects of shocks and impacts on the luminaire cover, a transparent protective cover is placed in front of the luminaire cover for a flameproof and impact-resistant embodiment of the cover. The invention also relates to an explosion-proof luminaire with a cover of this nature.

12 Claims, 1 Drawing Sheet

(56) References Cited

U.S. PATENT DOCUMENTS

| | | | | | |
|---|---|---|---|---|---|
| 2,089,049 | A * | 8/1937 | Benjamin | F21V 7/04 | 362/267 |
| 2,094,394 | A * | 9/1937 | Bissell | F21V 25/12 | 362/267 |
| 2,330,935 | A * | 10/1943 | Tuck | E04B 1/92 | 362/147 |
| 2,339,670 | A * | 1/1944 | Benson | F21V 25/12 | 362/267 |
| 2,786,936 | A * | 3/1957 | Appleton | F21V 25/04 | 362/363 |
| 2,849,597 | A * | 8/1958 | Petree | F21V 25/12 | 220/2.3 R |
| 4,489,367 | A * | 12/1984 | Herron | F21V 25/12 | 362/267 |
| 2004/0145899 | A1* | 7/2004 | Riebling et al. | | 362/487 |
| 2004/0252520 | A1* | 12/2004 | Martineau et al. | | 362/545 |
| 2010/0020557 | A1* | 1/2010 | Mukai et al. | | 362/470 |
| 2010/0072894 | A1* | 3/2010 | Shibahara et al. | | 315/32 |
| 2011/0089806 | A1* | 4/2011 | Suwa et al. | | 313/46 |
| 2011/0156587 | A1* | 6/2011 | Wu | | 315/35 |
| 2011/0266282 | A1* | 11/2011 | Chu | | 220/361 |
| 2012/0230044 | A1* | 9/2012 | Zhang et al. | | 362/487 |

FOREIGN PATENT DOCUMENTS

| | | | |
|---|---|---|---|
| DE | 1589395 | | 7/1970 |
| DE | 3622109 | A1 | 1/1988 |
| DE | 8802997.2 | U1 | 4/1988 |
| DE | 8500175.9 | U1 | 5/1988 |
| DE | 3940189 | A1 | 6/1991 |
| EP | 0431462 | A2 | 6/1991 |
| EP | 0556710 | A2 | 8/1993 |
| GB | 654205 | | 6/1951 |

OTHER PUBLICATIONS

Russell, Blokland, PCT/EP2012/002394 International Search Report, Oct. 12, 2012, 2 pages, European Patent Office.

European Patent Office, EP Application No. 12725632.9 EP Official Communication, Jan. 13, 2015, 5 pages, European Patent Office.

Chinese Office Action issued in Chinese Patent Application No. 201280038299.9, issued Jan. 28, 2016, 7 pages, The State Intellectual Property Office Of The People's Republic Of China.

Translation of Chinese Office Action issued in Chinese Patent Application No. 201280038299.9, issued Jan. 28, 2016, 5 pages.

Machine Translation of CN102047380 via Lexsisnexis Total Patents, 6 pages.

* cited by examiner

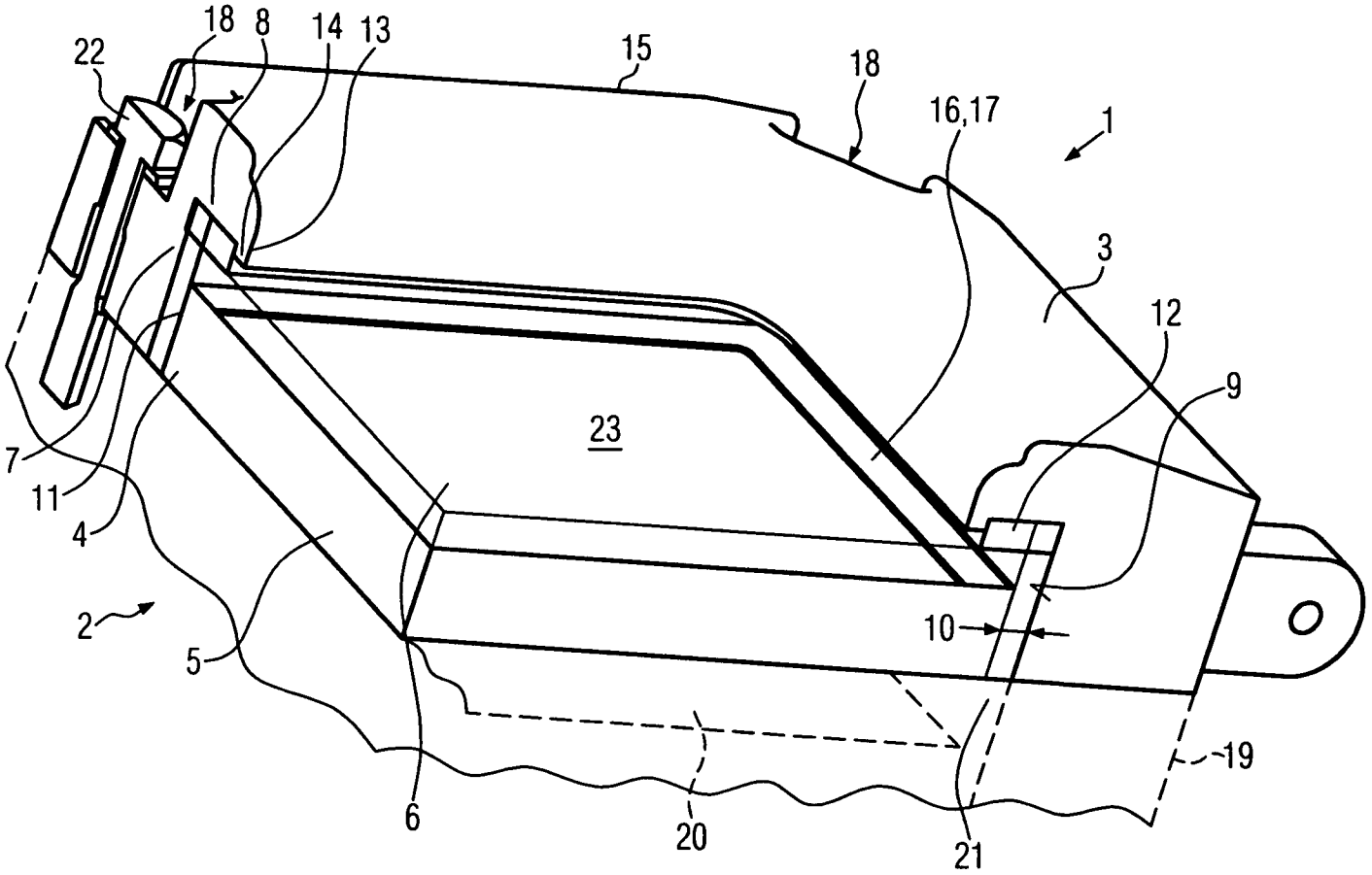
1
3
16,17
18
15
13
14
8
18
22
12
9
10
23
19
21
20
6
5
2
4
11
7

COVERING AND LUMINAIRE HAVING SUCH A COVERING

RELATED APPLICATIONS

This application is a Section 371 national phase application of and claims priority to PCT application PCT/EP2012/002394 filed on Jun. 4, 2012, which claims priority to German Patent Application Number 10 2011 103 491.2 filed on Jun. 3, 2011, the contents of which are incorporated herein in their entirety.

BACKGROUND

The invention relates to a cover, in particular for an explosion-proof luminaire. Luminaires of this nature generally comprise a housing and at least one light source, whereby a housing opening is closed by a cover of this nature. The cover generally comprises a mounting frame, which is detachable from the luminaire, and a transparent luminaire cover held at least along a circumferential edge by the mounting frame. Light from the light source emerges from the luminaire cover to facilitate appropriate illumination. Explosion-proof luminaires of this nature can be floodlight reflecting luminaires, searchlight luminaires, pendant luminaires or also other luminaires. An appropriate light source is, for example, a halogen bulb, filament bulb, high-pressure discharge tube or a plurality of light emitting diodes (LEDs). Apart from the appropriate light source, associated electrical and electronic equipment can be included for the operation and control of the light source in the explosion-proof luminaire.

A luminaire of this nature is employed in various temperature ranges. With both normal operation of the luminaires or also during tests or the like there is the danger that microcracks occur in the luminaire cover. They can negatively affect the stability of the luminaire cover and in particular the explosion-proof properties.

In order, for example, to avoid microcracks due to the effect of impacts, luminaires are presently being used in which the transparent luminaire cover is protected by a grid-like metal structure. However, such grid structures cannot be used for all luminaires, because, amongst other things, a large number of unwanted shadows can be produced by the grid structure.

In practice a further luminaire is known in which the transparent luminaire cover is relatively thick to avoid microcracks of this nature.

Both above mentioned examples lead to increased costs and increased weight. In addition, generally the light output is negatively affected; refer, for example, to the above mentioned shadows.

SUMMARY

The object of the present invention is to improve a cover of the type mentioned in the introduction such that with simple constructive means and without a substantial increase in weight or costs a cover can be provided which can also be used safely, in particular in areas subject to explosion hazard.

This object is solved by the features of Patent claim 1 through Patent claim 12 herein.

According to the invention, a transparent protective cover is placed in front of the luminaire cover for a flameproof and impact-resistant embodiment of the cover.

This means that in principle two appropriate transparent covers are used, of which in particular the luminaire cover fulfils the appropriate requirements with regard to explosion protection, whereas the protective cover at least increases the impact or shock resistance of the cover and optionally also contributes to the explosion protection. In this way relevant microcracks only occur in the outer protective cover without the corresponding luminaire cover, which is more closely adjacent to the light source, being negatively affected in this respect.

There is the possibility of forming the transparent protective cover relatively thinly, because the protective cover can withstand the relevant impacts or shocks in an adequate manner. Also during impact tests for inspecting the cover or luminaire in this connection only the outer protective cover is subjected directly to the force of relevant impacts or shocks, whereas the luminaire cover is protected by the protective cover. The said microcracks will only occur in the protective cover so that the luminaire cover continues to fulfil all requirements of flameproof and explosion-proof capabilities within a large temperature range.

In an advantageous embodiment it is conceivable that the luminaire cover and the protective cover are formed essentially with the same geometrical dimensions. This means that they have the same width and length with regard to a corresponding light outlet of the luminaire, whereby however the thickness can be different. As a rule the luminaire cover is thicker than the protective cover.

It is conceivable that the luminaire and/or protective cover are made from a transparent plastic material. Advantageously, they can however be formed from glass. Preferred types of glass are, for example, borosilicate glass or mineral glass.

There is also the possibility that the luminaire and protective covers are manufactured from different materials, whereby an impact or shock-resistant glass can be selected for the protective cover.

Due to appropriate similar geometrical dimensions of both covers, they can be held with respect to the luminaire simply by the mounting frame and fixed relative to the luminaire.

In an advantageous embodiment it can prove to be favourable if the mounting frame comprises an essentially inverted L-shaped cross section along the circumferential edge of the corresponding covers. This provides both sidewards retention and also fixing of the luminaire and protective covers outwards.

In order to be able to handle the cover together with the luminaire and/or protective cover more easily, it can be considered furthermore advantageous, if side adhesion is provided along a longer L-limb between it and the covers. In this way both the luminaire and the protective cover can be preassembled before appropriate installation of the cover on the luminaire. There is however also the possibility that a corresponding adhesive is applied later on site directly when fitting the cover on the luminaire.

In this connection it may be furthermore favourable if the side adhesion is formed essentially with the same adhesive thickness both along the circumferential edge as well as with regard to the luminaire and protective covers. In this way the appropriate side adhesion can be implemented as a uniformly spread adhesive before the luminaire and protective covers are fitted.

The corresponding side adhesion generally extends over the complete height of the covers so that they are securely held and adhere along their circumference.

In order to prevent the ingress of explosive gases, dirt or the like between the luminaire and protective covers, the protective cover and the luminaire cover can be sealed relative to one another at least in places.

An easily implemented embodiment can be seen in this connection if an appropriate sealing material is arranged along the circumference between the protective cover and the luminaire cover. An example of a sealing material of this nature is a thin sealing strip, which, for example, is fitted to a rear side of the protective cover before the luminaire cover is arranged. Following that the luminaire cover is then pressed onto the protective cover so that the appropriate sealing strip is also subjected to force along its complete length and adequate sealing is formed between the protective cover and the luminaire cover. At the same time appropriate hardening of the side adhesive can occur so that in this way secure fixation of the luminaire and protective covers is ensured relative to one another with the sealing strip arranged between them.

Sealing not only of the covers relative to one another, but also of the cover relative to the luminaire can furthermore be improved in that an end seal is arranged between the shorter L-limb and the protective cover. This can, for example, essentially extend parallel to the sealing strip along an outer side of the protective cover.

In order to fix this end seal in a simple manner and to simultaneously form a type of labyrinth seal in this region, the shorter L-limb can comprise an end projection pointing in the direction of the protective cover at its free end. The above mentioned end seal can be arranged and held between this projection and the longer L-limb.

In order to prevent optionally the end projection from contacting and scratching or even damaging the protective cover when assembling the cover, the end projection can terminate spaced from the protective cover.

To prevent optionally the side adhesive, sealing strip or end seal from affecting the light output of an appropriate luminaire, or that optionally contamination arising during their fitting is visible, the side adhesive, sealing strip and end seal can be covered by the mounting frame, particularly in the direction of the light outlet.

In order to be able to fasten the cover to an appropriate luminaire in a simple manner, the mounting frame can comprise a number of mounting recesses along its circumference. In each of these mounting recesses a screw, for example, can be arranged which detachably fastens the mounting frame and thus the cover with the associated parts on the luminaire through appropriate screwing to the luminaire.

The invention also relates to an appropriate explosion-proof luminaire with a housing and a light source arranged in the housing and to an above-mentioned cover for a light outlet of the housing.

BRIEF DESCRIPTION OF THE DRAWINGS

In the following, an advantageous embodiment of the invention is described in more detail based on the enclosed FIGURE.

The following are shown:

FIG. 1 an embodiment, illustrated partly in perspective, of a cover according to the invention.

DETAILED DESCRIPTION OF EXAMPLE EMBODIMENTS

FIG. 1 shows a partially perspective illustration of an embodiment of a cover 1 according to the invention. It is used for the detachable covering of a light outlet 21 of a housing 19 of a particularly explosion-proof luminaire 2. Within the housing 19 there is/are arranged, for example, a halogen bulb, high-pressure discharge tube or also a plurality of LEDs as the light source 20.

The cover 1 can be fastened to the housing 19 of the luminaire 2 by means of a number of screws 22. These screws 22 are arranged in mounting recesses 18 along a circumference 15 of a mounting frame 3 of the cover 1. For simplification an appropriate further means of sealing between the cover 1 and luminaire 2 is not illustrated in FIG. 1.

The cover 1 is fitted to the luminaire 2 such that it is overall explosion-proof and can be used in areas subject to explosion hazard. A luminaire of this nature is, for example, a floodlight reflecting luminaire, searchlight luminaire, pendant luminaire or the like.

Part of the cover 1 is a transparent luminaire cover 5 generally formed in glass. Light from the light source 20 emerges from the luminaire 2 through said cover. The luminaire cover 5 is fastened to the luminaire housing 19 by means of the mounting frame 3.

In order to protect the luminaire cover 5 from shocks and impacts through which optionally microcracks can arise in the luminaire cover 5, a similarly transparent protective cover 6 is placed in front of the luminaire cover 5. The luminaire cover 5 and the protective cover 6 can both be formed from glass, such as for example mineral glass or borosilicate glass. As a rule the luminaire cover 5 is thicker than the protective cover 6. The protective cover 6 lies flat on an outer side of the luminaire cover 5, whereby a sealing material 16 in the form of a sealing strip 17 is arranged along a circumferential edge 4 between the two covers. In this way a slight distance between the luminaire cover 5 and the protective cover 6 can be provided outside of this sealing strip 17, which additionally prevents transfer of relevant shocks or impacts to the luminaire cover 5. The relevant shocks or impacts are absorbed by the protective cover 6 so that optionally relevant microcracks only arise in said cover.

If relevant microcracks were also to arise in the luminaire cover 5, its explosion-proof properties could be negatively affected. For example, microcracks of this nature would negatively affect the stability of the luminaire cover 5 with regard to an appropriate application of pressure from within the luminaire 2. Microcracks of this nature occur according to the invention generally only in the appropriate protective cover 6 so that the explosion-proof properties of the luminaire cover 5 or of the luminaire 2 overall are in no way negatively affected. Additionally, the protective cover 6 is relatively thin so that neither the weight of the relevant luminaire nor its construction with corresponding manufacturing costs is negatively affected.

The luminaire cover 5 and protective cover 6 are held along their circumferential edge 4 by the mounting frame 3. To fix both covers 5, 6 a side adhesive 9 is used, which extends along a longer L-limb 7 of the mounting frame 3. In the region of the circumferential edge 4 this mounting frame 3 comprises an inverted L-shaped cross section. Apart from the longer L-limb 7, a shorter L-limb 8 is provided which extends inwards over the circumferential edge 4 of the luminaire cover 5 and the protective cover 6. Between the shorter L-limb 8 and an upper side 23 of the protective cover 6 an end seal 12 is arranged, which extends essentially strip-shaped along the circumferential edge 4 between these two covers. To hold the appropriate end seal 12 the shorter L-limb 8 has at its free end 13 an end projection 14 protruding in the direction of the upper side 23 of the protective cover 6. This said projection terminates spaced from the upper side 23.

With the illustrated embodiment the side adhesion 9 extends along the luminaire cover 5 and protective cover 6, but terminates essentially flush with the upper side 23 of the protective cover 6. There is also the possibility that either the side adhesion 9 extends behind the end seal 12 or that the end seal 12 also extends above the side adhesion 9.

An appropriate adhesive thickness 10 of the side adhesion 9 is essentially constant over its extent along the edges of the luminaire cover 5 and protective cover 6, whereby the side adhesion 9 extends along the whole circumference 11 of the luminaire cover 5 and protective cover 6.

Through the cover 1 according to the invention an appropriate explosion-proof luminaire 2 is, in a simple and safe manner, protected without substantial additional costs from being subjected to shocks and impacts so that the occurrence of microcracks in the luminaire cover 5 is largely prevented. In this way the luminaire with a cover of this nature can be used in regions subject to explosion hazard without impairing its appropriate explosion-proof properties.

Any shocks or impacts are no longer directly exerted on the luminaire cover 5, but rather absorbed by the protective cover 6. The prevention of corresponding microcracks in the luminaire cover 5 enables it to withstand appropriate pressure tests for the inspection of the explosion-proof properties.

The invention claimed is:

1. An explosion-proof luminaire (2), with a mounting frame (3) which can be detachably fastened to the luminaire (2) and a transparent protective cover (6) held by the mounting frame at least along a circumferential edge (4), wherein the transparent protective cover (6) is placed in front of the luminaire cover (5) for a flameproof and impact-resistant embodiment of the cover (1), wherein the luminaire cover (5) and the transparent protective cover (6) are sealed relative to one another, at least in places, using a sealing material (16) arranged along a circumference (11) between the transparent protective cover (6) and the luminaire cover (5), wherein the sealing material (16) is a sealing strip (17).

2. The explosion-proof luminaire according to claim 1, wherein the protective cover (6) and luminaire cover (5) are essentially formed with the same geometrical dimensions.

3. The explosion-proof luminaire according to claim 1, wherein the protective cover (6) and the luminaire cover (5) are formed from glass.

4. The explosion-proof luminaire according to claim 1, wherein the mounting frame (3) along the circumferential edge (4) comprises essentially an inverted L-shaped cross section (7, 8).

5. The explosion-proof luminaire according to claim 1, wherein a side adhesion (9) is provided along a longer L-limb (7) between said limb and the protective cover (6).

6. The explosion-proof luminaire according to claim 5, wherein the side adhesion (9) is essentially formed with uniform adhesive thickness (10).

7. The explosion-proof luminaire according to claim 1, wherein an end seal (12) is arranged between a shorter L-limb (8) and the protective cover (6).

8. The explosion-proof luminaire according to claim 1, wherein a shorter L-limb (8) comprises an end projection (14) at its free end (13) pointing in the direction of the protective cover (6).

9. The explosion-proof luminaire according to claim 1, wherein the end projection (14) terminates spaced to the protective cover (6).

10. The explosion-proof luminaire according to claim 1, wherein the side adhesive (9), the sealing strip (17) and an end seal (12) are covered by the mounting frame (3).

11. The explosion-proof luminaire according to claim 1, wherein the mounting frame (3) comprises a number of mounting recesses (18) along its circumference (15).

12. The explosion-proof luminaire (2) according to claim 1, with a light source arranged in a housing.

* * * * *